US006948849B2

(12) United States Patent
Schreiter

(10) Patent No.: US 6,948,849 B2
(45) Date of Patent: Sep. 27, 2005

(54) RESEALABLE CLOSURE MECHANISM HAVING A SLIDER DEVICE AND METHODS

(75) Inventor: Michael E. Schreiter, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 10/464,700

(22) Filed: Jun. 18, 2003

(65) Prior Publication Data

US 2004/0022461 A1 Feb. 5, 2004

Related U.S. Application Data

(62) Division of application No. 09/725,977, filed on Nov. 29, 2000, now Pat. No. 6,679,027.

(51) Int. Cl.[7] ..... B65D 33/16
(52) U.S. Cl. ..... 383/64; 24/399
(58) Field of Search ..... 383/64; 24/399–400

(56) References Cited

U.S. PATENT DOCUMENTS

| | | | | |
|---|---|---|---|---|
| 2,909,822 A | | 10/1959 | Botti et al. | |
| 3,074,137 A | | 1/1963 | Hawley | |
| 3,173,184 A | | 3/1965 | Ausnit | |
| 3,220,076 A | | 11/1965 | Ausnit | |
| 3,259,951 A | | 7/1966 | Zimmerman | |
| 3,579,747 A | | 5/1971 | Hawley | |
| 3,660,875 A | | 5/1972 | Gutman | |
| 3,790,993 A | | 2/1974 | Gilles et al. | |
| 4,812,056 A | | 3/1989 | Zicke | |
| 4,944,072 A | | 7/1990 | Robson | |
| 5,007,143 A | | 4/1991 | Herrington | |
| 5,664,299 A | | 9/1997 | Porchia et al. | |
| 5,689,866 A | | 11/1997 | Kasai et al. | |
| 5,809,621 A | | 9/1998 | McCree et al. | |
| 5,896,627 A | | 4/1999 | Cappel et al. | |
| 5,953,796 A | | 9/1999 | McMahon et al. | |
| 6,439,771 B1 | * | 8/2002 | Herrington, Jr. | 383/64 |
| 6,491,432 B2 | * | 12/2002 | May | 383/64 |
| 6,581,253 B2 | * | 6/2003 | ErkenBrack | 24/428 |
| 6,679,027 B2 | * | 1/2004 | Schreiter | 53/412 |

FOREIGN PATENT DOCUMENTS

| | | |
|---|---|---|
| CH | 593 646 | 3/1976 |
| DE | 2126 638 | 12/1971 |
| EP | 0 479 661 A1 | 9/1991 |
| WO | WO 92/17085 | 10/1992 |

* cited by examiner

*Primary Examiner*—Jes F. Pascua
(74) *Attorney, Agent, or Firm*—Eckert Seamans Cherin & Mellott; Tracey D. Beiriger

(57) ABSTRACT

A slider device having contoured top and sidewalls is disclosed for use with a resealable package. In a first embodiment, the slider device includes an engagement structure for engaging and interlocking first and second closure profiles of a resealable closure mechanism. The engagement structure includes a first protrusion and a second protrusion depending from the top wall of the slider device for engaging first and second closure profiles of a resealable closure mechanism. The first and second protrusions selectively open and close the resealable closure mechanism as the slider device is moved from a first position to a second position. In a second embodiment, a slider device is disclosed having first and second slide channels that engage first and second closure profiles. The first and second slide channels selectively open and close the resealable closure mechanism as the slider device is moved from a first position to a second position.

11 Claims, 6 Drawing Sheets

RESEALABLE CLOSURE MECHANISM HAVING A SLIDER DEVICE AND METHODS

CROSS REFERENCE TO RELATED APPLICATION

Priority under 35 U.S.C. § 119(e) is a division of and claimed to utility application Ser. No. 09/725,977 filed on Nov. 29, 2000, now U.S. Pat. No. 6,679,027, entitled "Resealable Closure Mechanism Having A Slider Device And Methods." The complete disclosure of application Ser. No. 09/725,977 is incorporated by reference herein.

FIELD OF THE INVENTION

This disclosure generally relates to closure arrangements for polymer packages, such as, plastic bags. In particular, this disclosure relates to resealable closure mechanisms or zipper-type closures for resealable packages.

BACKGROUND OF THE INVENTION

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. The slider device typically includes a separator or spreader-type structure at one end that opens a closure mechanism, having profiled elements or closure profiles, when the slider device travels in a first direction along the mechanism. The sidewalls of the slider device are configured so that the sidewalls engage the closure profiles and progressively move them into engagement to close the resealable package when the slider device is moved along the closure mechanism in a direction opposite the first direction.

Improvements in the design and manufacture of closure mechanisms and slider devices are desirable.

SUMMARY OF THE INVENTION

In general terms, this disclosure relates to resealable closure mechanisms having slider devices operably mounted thereon for selectively opening or closing the resealable closure mechanism. In one aspect, a slider device having contoured top and sidewalls is disclosed for use with a resealable closure mechanism having a first closure profile and a second closure profile. One embodiment of a slider device includes an engagement structure for engaging and interlocking first and second closure profiles of a resealable closure mechanism. For example, the slider device includes a top wall having a first protrusion integral with the top wall at a first end of the slider device and a second protrusion integral with the top wall at a second end of the slider device. The first and second protrusions are constructed and arranged to engage the first and second closure profiles to selectively open and close the resealable closure mechanism as the slider device is moved from a first position to a second position.

The disclosure also concerns a reclosable zipper arrangement. In one embodiment described, the zipper arrangement includes a first closure profile defining a first closure member having an upper latching portion and a lower latching portion. The first closure profile also includes a locking finger. The zipper arrangement also includes a second closure profile having a second closure member with a catch. A slider device is provided to engage the locking finger such that the lower latching portion of the first catch interlocks with the second catch of the second closure member when said slider device is selectively moved along the resealable closure mechanism in a first direction.

In a second embodiment, a second slider device includes a top wall, a first and second sidewall depending from the top wall. The first and second sidewalls define slide channels that receive and engage the first and second closure profiles to selectively open and close a resealable closure mechanism as the slider device is moved from a first position to a second position.

A second embodiment of a resealable closure mechanism operable with the second slider device is also disclosed. In the second embodiment, the zipper arrangement includes a first closure profile defining a first closure member having a catch, and a lever or flange member cantilevered from the first closure profile opposite the first closure member. The zipper arrangement also includes a second closure profile defining a second closure member, and a lever or flange member cantilevered from the second closure profile opposite the second closure member. The slide channels of the slider device receive and engage the flange members of the first and second closure profiles such that the first and second closure members interlock when the slider device is moved in a first direction and disengage when the slider device is moved in a second direction.

Methods of using a resealable package are described. Methods include a step of moving a slider device along a mouth a first direction from a side seal of the resealable package such that the contoured top and sidewalls of the slider device engage the first and second closure profiles of the resealable closure mechanism. Packages and slider devices as described herein may be usable in this method.

DETAILED DESCRIPTION OF PREFERRED EMBODIMENTS

Figure 1:
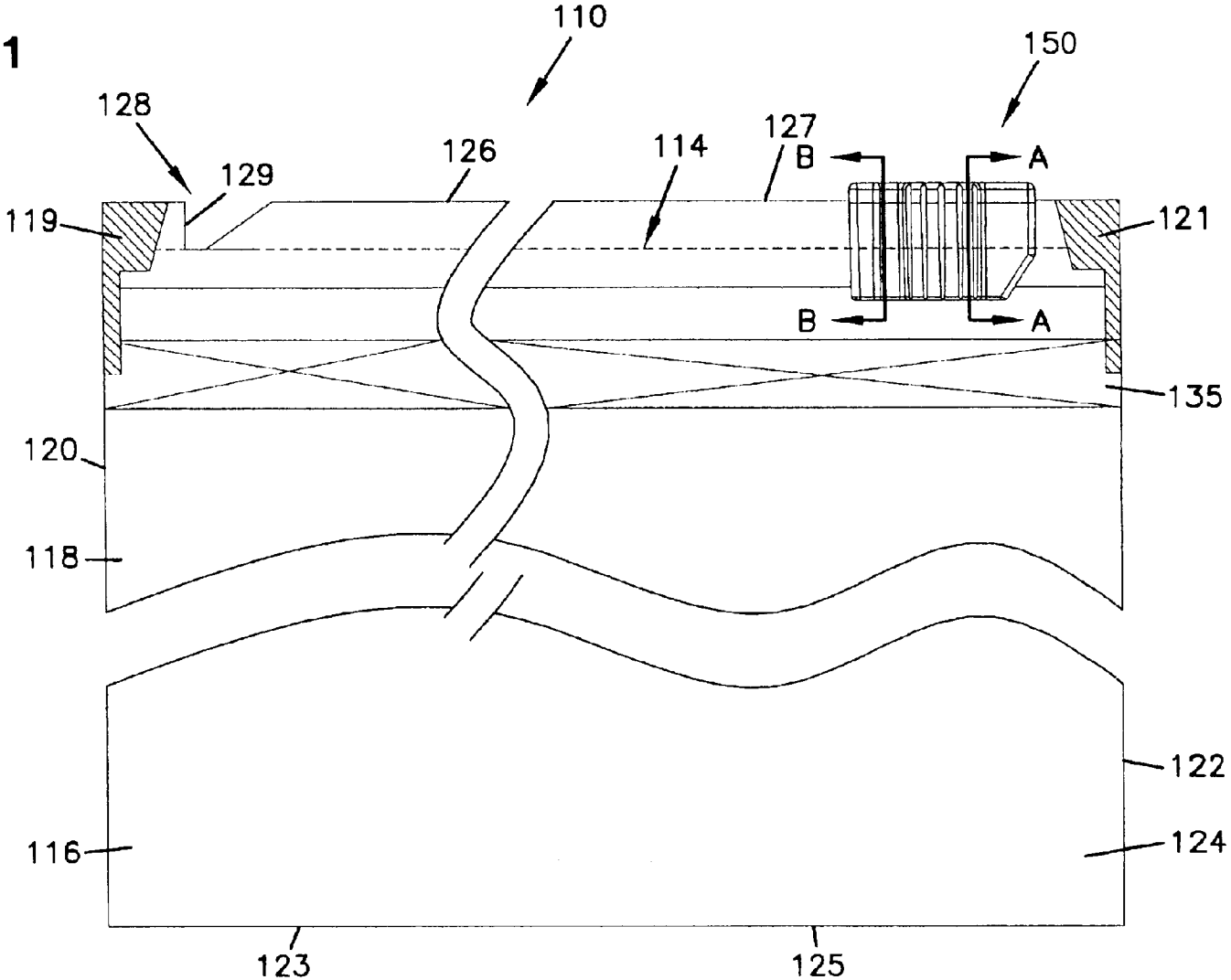
FIG. 1 is a side elevational, schematic view of a flexible, resealable package having a slider device, according to principles of this disclosure.

Attention is directed to FIG. 1. FIG. 1 illustrates an example packaging arrangement in the form of a resealable, flexible package 110, for example, a polymeric package such as a plastic bag, having a resealable closure mechanism 114, for example, interlocking profiled elements, constructed in accordance with the principles of this disclosure. The flexible package 110 includes first and second opposed panel sections 116, 118, typically made from a flexible, polymeric, plastic film. With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110. The resealable closure mechanism 114 can be one of a variety of closure mechanisms. In the particular embodiment illustrated in FIG. 2, the resealable closure mechanism 200 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
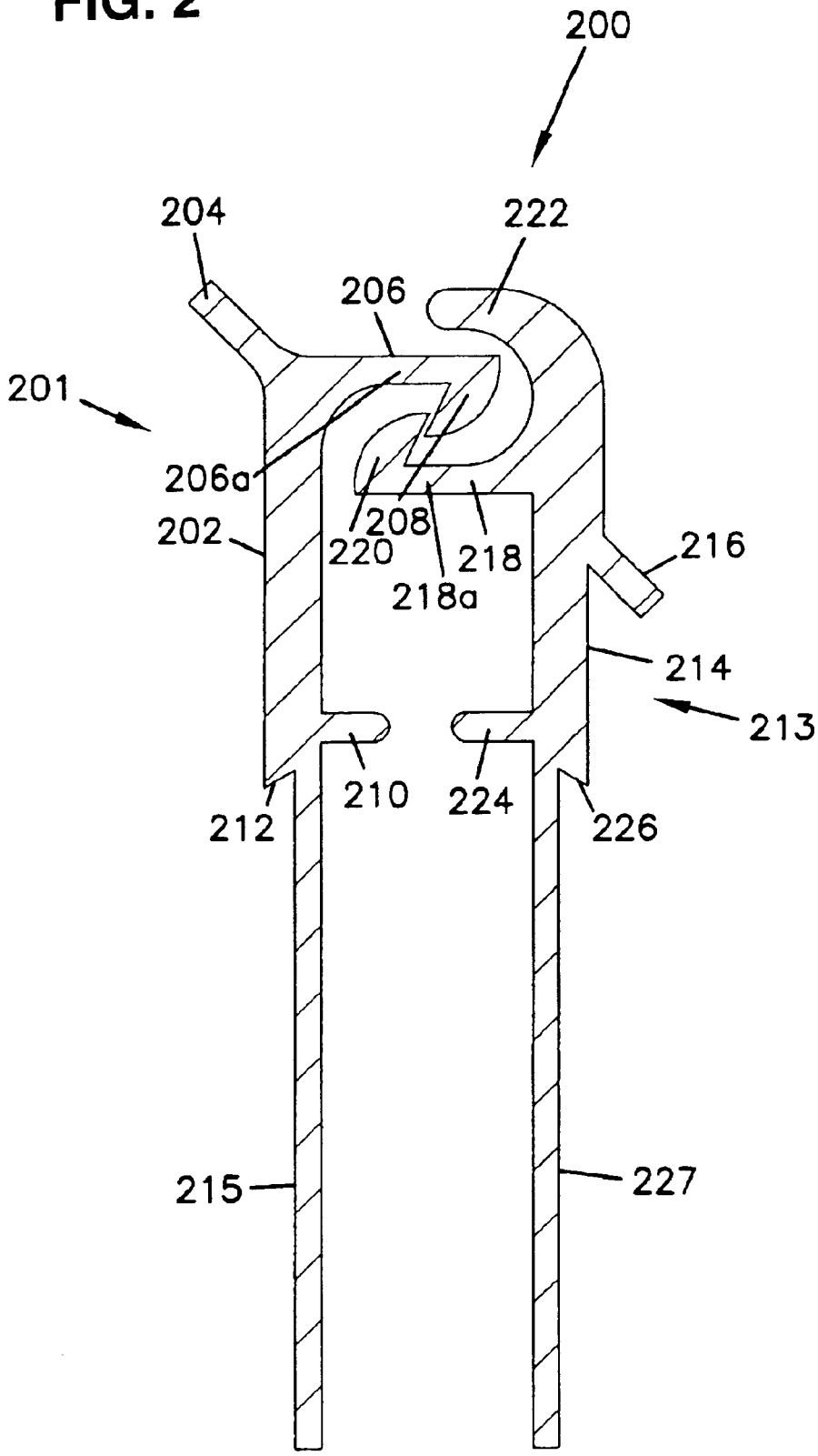
FIG. 2 is a cross-sectional view of a second embodiment of profiled elements usable with the resealable package of FIG. 1, according to principles of this disclosure.

FIGS. 2 through 8 illustrate one embodiment of a slider device having contoured top and sidewalls for engaging or interfacing with a resealable closure mechanism. In particular, the zipper-type closure mechanism shown in FIG. 2 is an illustration of an embodiment of a resealable closure mechanism 114 (FIG. 1) for use with a slider device having contoured top and sidewalls. The closure mechanism 200 in FIG. 2 includes an elongated first closure profile 201 and an elongated second closure profile 213. As discussed above with respect to the closure mechanism 114, typically, the closure profiles 201, 213 are manufactured separately from each other.

Still in reference to FIG. 2, the first closure profile 201 includes a sealing flange or bonding strip 215, a base strip 202, a first closure member 206, a first guidepost 210, and a flange or lever member 204. The closure member 206 extends from the base strip 202 by way of a stem 206*a* and is generally projecting from the base strip 202. At a free end of the stem 206*a* (the tip of the closure member 206) is a hook or catch 208. The flange or lever member 204 extends from the base strip 202 opposite the closure member 206. The guidepost 210 extends from and is generally projecting from the base strip 202. The guidepost 210 adds rigidity to the lower portion of the first closure profile 201. The bonding strip 215 depends or extends downward from the guidepost 210 and can be attached to a first panel section, such as the first panel section 116 of the package 110 of FIG. 1 at region 135 (FIG. 1). A first shoulder 212 is defined by the intersection of the base strip 202 and bonding strip 215. In the example illustrated, the bonding strip 215 is spaced a distance laterally from the base strip 202 to define a corner forming the shoulder 212.

The preferred second closure profile 213 includes a bonding strip 227, a base strip 214, a first guidepost 224, a second guidepost 222, and a second closure member 218. The closure member 218 extends from the base strip 214 by way of a stem 218*a* and is generally projecting from the base strip 214. At a free end of the stem 218*a* (or tip of the closure member 218) is a hook or catch 220. A flange or lever member 216 extends from the base strip 214 opposite the second closure member 218. The first guidepost 224 extends from the base strip 214 and is generally projecting from the base strip 214. The first guidepost 224 adds rigidity to the lower portion of the second closure profile 213. The second guidepost 222 also extends from and is generally projecting from the base strip 214. The second guide post 222 aids in holding the closure mechanism 200 closed and in aligning the first closure profile 201 with the second closure profile 213 for interlocking. The bonding strip 227 depends or extends downward from the base strip 214 and can be attached to a second panel section, such as the second panel section 118 of the package 110 of FIG. 1. A shoulder 226, analogous to the shoulder 212, is formed at the corner of the bonding strip 227 and the base strip 214.

The first and second closure profiles 210, 213 are designed to engage with one another to form the resealable closure mechanism 200. The closure member 218 of the first closure profile 213 extends from the base strip 214 a first distance. The closure member 218 of the second closure profile 213 also extends from the base strip 214 a first distance. These first distances that the closure members 201, 213 extend are sufficient to allow mechanical engagement, or interlocking, between the first closure member 206 of the first closure profile 201 and the second closure member 218 of the second closure profile 213. Therefore, the catches 208, 220 are allowed to hook or engage each other. Furthermore, as discussed above in connection with resealable closure mechanism 114, the closure profiles 201, 213 are sealed together at their ends, such as regions 119, 121 of FIG. 1, to further aid in aligning the closure profiles 201, 213 for interlocking through processes such as ultrasonic crushing.

The first flange member 204 is cantilevered from the first closure profile 201 at an angle of about between 20 and 70 degrees, typically between 40 and 50 degrees, and preferably 45 degrees with respect to the base strip 202. Similarly, the second flange member 216 is cantilevered from the second closure profile 213 at an angle of about between 20 and 70 degrees, typically between 40 and 50 degrees, and preferably 45 degrees with respect to the base strip 214.

The openable sealed closure mechanism 200 is formed by pushing the closure profiles 201, 213 towards one another into engagement. For example, the first and second closure profiles 201, 213 can be pushed towards one another such that the distance between the first and second closure profiles 201, 213 is reduced. Similarly, the distance between the first and second bonding strips 215, 227 is also reduced. In so doing, the first closure member 201 interlocks with the second closure member 213. As discussed above, the second guide post 222 aids in aligning the first and second closure profiles 210, 213 with one another, thereby, facilitating interlocking between the two.

To disengage the first and second closure profiles 201, 213 from one another, each of the flange members 204, 216 can be acted on to disengage the first closure profile 201 from the second closure profile 213. For example, in the embodiment shown in FIG. 2, the first flange member 204 of the first closure profile 201 can be pushed downward. In so doing, the first closure member 206 is forced upwards and out of engagement with the second closure member 218. Similarly, the second flange member 216 can be directed upwards, thereby forcing the second closure member 218 downward and out of engagement with the first closure member 218. Once the first and second closure members 206, 218 are disengaged, the first and second closure profiles 201, 213 can be pulled apart to provide access to the contents of the package 110 through the mouth 126 (FIG. 1).

The closure profiles 201, 213 are formed by two separate extrusions or through two separate openings of a common extrusion. Typically, the resealable closure mechanism 200 is made of conventional materials, such as a polymeric, plastic material, for example, polyethylene or polypropylene. In one example embodiment, the closure arrangement illustrated in FIG. 2 is manufactured using conventional extrusion and heat-sealing techniques.

Figure 3:
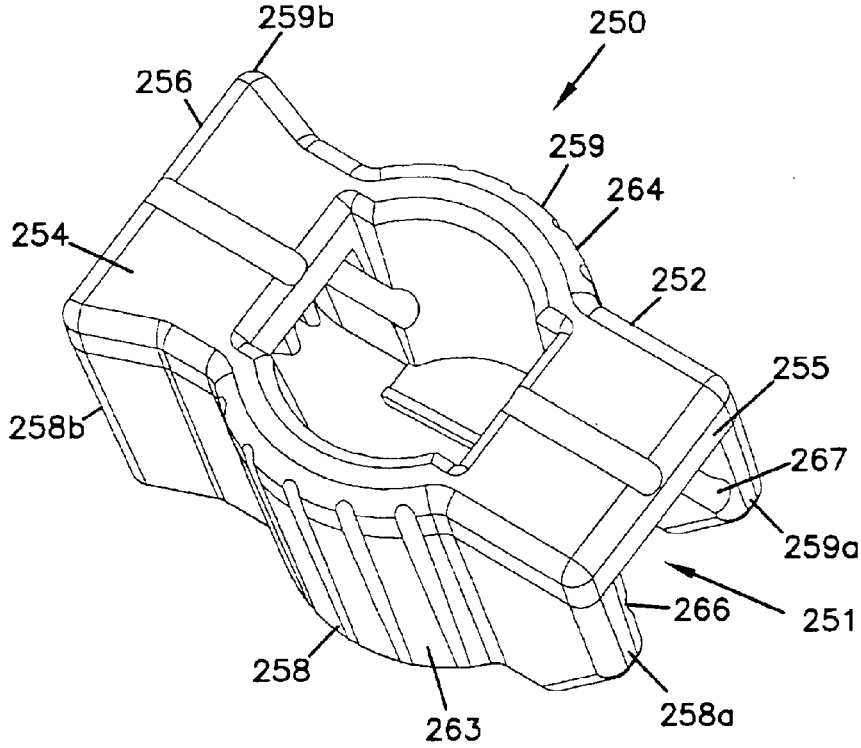
FIG. 3 is an enlarged, top perspective view of a second embodiment of the slider device of FIG. 1.
Figure 4:
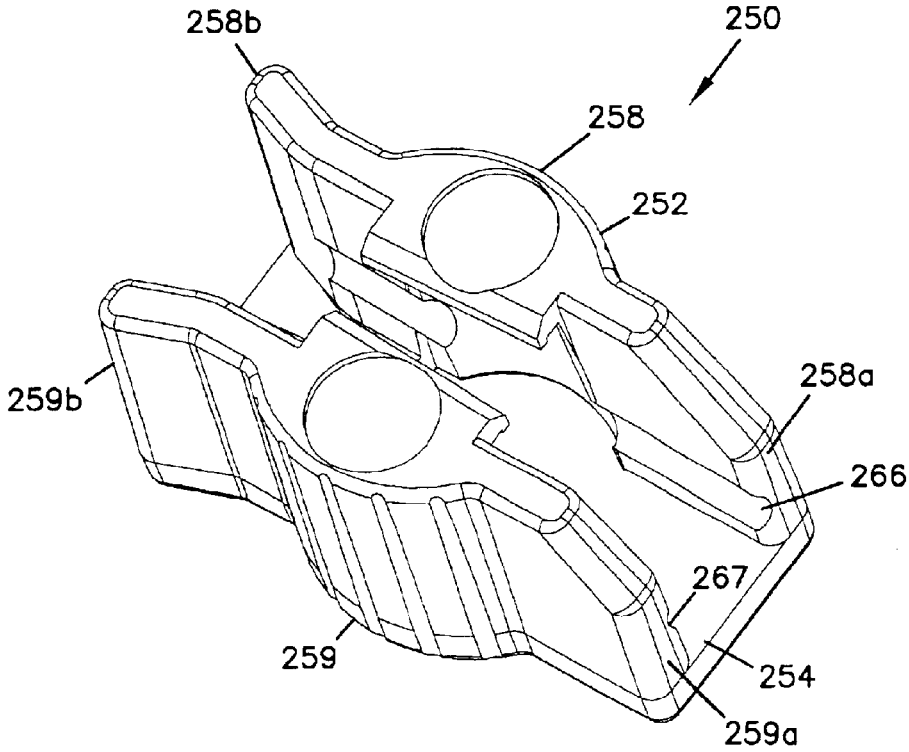
FIG. 4 is an enlarged, bottom perspective view of the slider device of FIG. 3.

FIGS. 3 and 4 illustrate a slider device having contoured sidewalls that engage or interlock with the first and second closure profiles 201, 213 to selectively open and close the resealable closure mechanism 200. A preferred slider device 250 is illustrated in FIGS. 3 and 4 in perspective view and preferably comprises a one-piece unitary, molded plastic member with no moveable parts that are moveable with respect to one another. In general, the slider device 250 includes a housing 252 for slidably engaging the closure mechanism 220. The housing 252 is movable between a closed position of the resealable package 110 (such as the resealable package shown in FIG. 1) when the housing 252 is adjacent the side edge 120 and an open position of the resealable package 110 when the housing 252 is adjacent the side edge 122. For example, FIG. 1 illustrates the resealable package 110 in an open position. The housing 252 slides over the resealable closure mechanism 200 relative to the top edge 127 of the resealable package 110 to open and close the mouth 126.

The housing 252 is preferably a multi-sided container configured for engaging or locking onto or over the resealable closure mechanism 114. In the particular embodiment illustrated in FIGS. 3 and 4, the housing 252 includes a top wall 254. By the term "top", it is meant that in the orientation of the slider device 250 shown in FIG. 1, the wall 254 is oriented above the remaining portions of the housing 252, such as the sidewalls 258, 259. It should be understood, of course, that if the housing 252 is moved from the orientation shown in FIG. 1, the top wall 254 will not be in a top orientation. The top wall 254 defines a first or front end 255 and an opposite second or rear end 256.

In reference again to FIGS. 3 and 4, the preferred housing 252 shown also includes first and second sidewalls 258, 259. Preferably, each of the first and second sidewalls 258, 259 extends from and is cantilevered from the top wall 254 to form a slide channel 251 therebetween. In the preferred embodiment, the first and second sidewalls 258, 259 are injection molded with the remaining parts of the housing 252. In other words, preferably the housing 252 comprises a single, unitary, integral piece of material with no additional materials welded, fastened, or bolted together. As with the slider device 150 described above, the sidewalls 258, 259 of the slider device 250 can include texturization, such as ribs, 263, 264 to help improve gripping and handling by the user.

In the embodiment shown in FIGS. 3 and 4, each of the first and second sidewalls 258, 259 define a slide channel 266, 267 for receiving and engaging the flange or lever members 204, 216 of the resealable closure mechanism 200. Each of the slide channels 266, 267 define a guide construction for receiving and engaging respective flange members 204, 216 of the resealable closure mechanism 200. The slide channel 266 defined in the first sidewall 258 extends from the first end 258*a* to the second end 258*b*. Similarly, the slide channel 267 defined in the second sidewall 259 extends from the first end 259*a* to the second end 259*b*.

Figure 5:
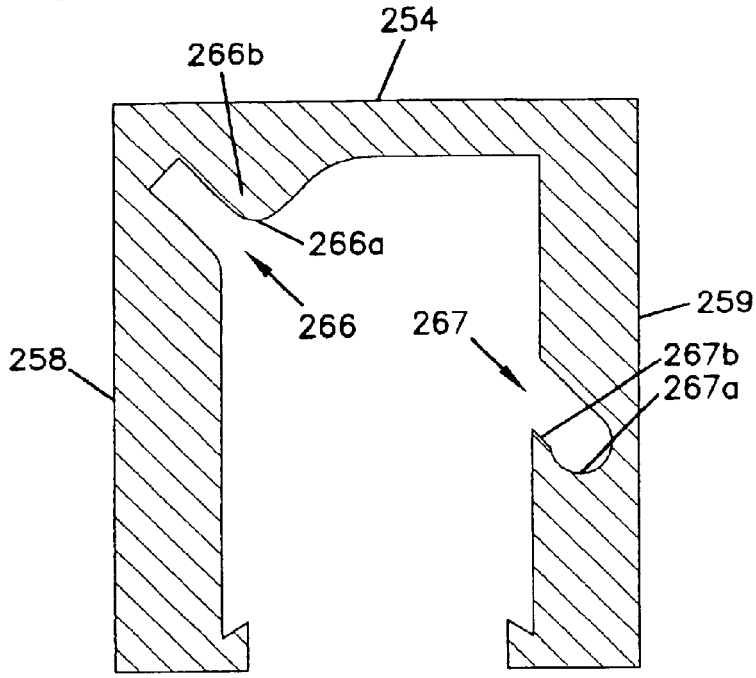
FIG. 5 is a cross-sectional view of the slider device of FIGS. 3 and 4 taken along the line A—A of FIG. 1.

FIG. 5 is a cross-sectional view of the slider device 250 taken at its first end 255. At their respective first ends 258*a*, 259*a*, the slide channels 266, 267 includes first and second contoured inner surfaces 266*a*, 267*a* projecting or extending into respective slide channels 266, 267. The first slide channel 266 at or substantially near the first end 258*a* includes an angling or jutting portion 266*b* that extends from the top wall 259 and is sized and configured to accommodate the flange or lever members 204 of the first closure profile 201. Similarly, the second slide channel 267 at or substantially near the first end 259*a* includes an angling or jutting portion 267*b* sized and configured to accommodate the flange or lever member 216 of the second closure profile 213. By "substantially near," it is meant that the configuration of the angling or jutting porting 266*b*, 267*b* extends no further than about 50% of the length of the first slide channel 266 from the first ends 258*a*, 259*a*, preferably about 25% of the length of the first slide channel 266 from the first ends 258*a*, 259*a*. Moreover, by "accommodate," it is meant that the configuration of the slide channels 266, 267 do not engage, deflect, or exert any forces on the flange or lever members 204, 216. Accordingly, when the resealable closure mechanism 200 is positioned at or near the first end 258*a*, 259*a* of the slide channels 266, 267, the first and second closure profiles 210, 213 are allowed to remain in a natural, unbiased configuration as shown in FIG. 2.

Figure 6:
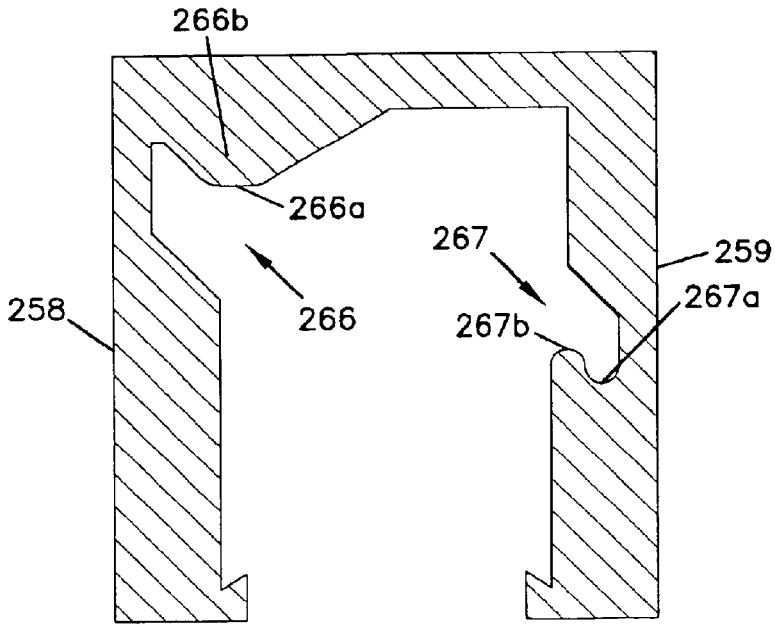
FIG. 6 is a cross-sectional view of the slider device of FIGS. 3 and 4 taken along the line B—B of FIG. 1.

FIG. 6 is a cross-sectional view of the slider device 250 taken at its second end 256. The first contoured inner surface 266*a* at or substantially near its second end 258*b* is configured to engage the flange or lever member 204 of the first closure profile 201. Specifically, the angling or jutting portion 266*b* is sized and configured to engage the flange or lever member 204 of the first closure profile 201. Similarly, the second contoured inner surface 267*a* (FIG. 6) at or near its second end 259*b* is configured to engage the flange or lever member 216 of the second closure profile 213. Specifically, the angling or jutting portion 267*b* is sized and configured to engage the flange or lever member 216. By "engage," it is meant that the first and second contoured inner surfaces 266*a*, 267*a* deflect the flange or lever members 204, 216 such that the closure members 206, 218 disengage. Accordingly, when the resealable closure mechanism 200 is positioned at or near the second end 258*b*, 259*b* of the slide channels 266, 267, the first and second closure profiles 210, 213 disengage from one another.

Figure 7:
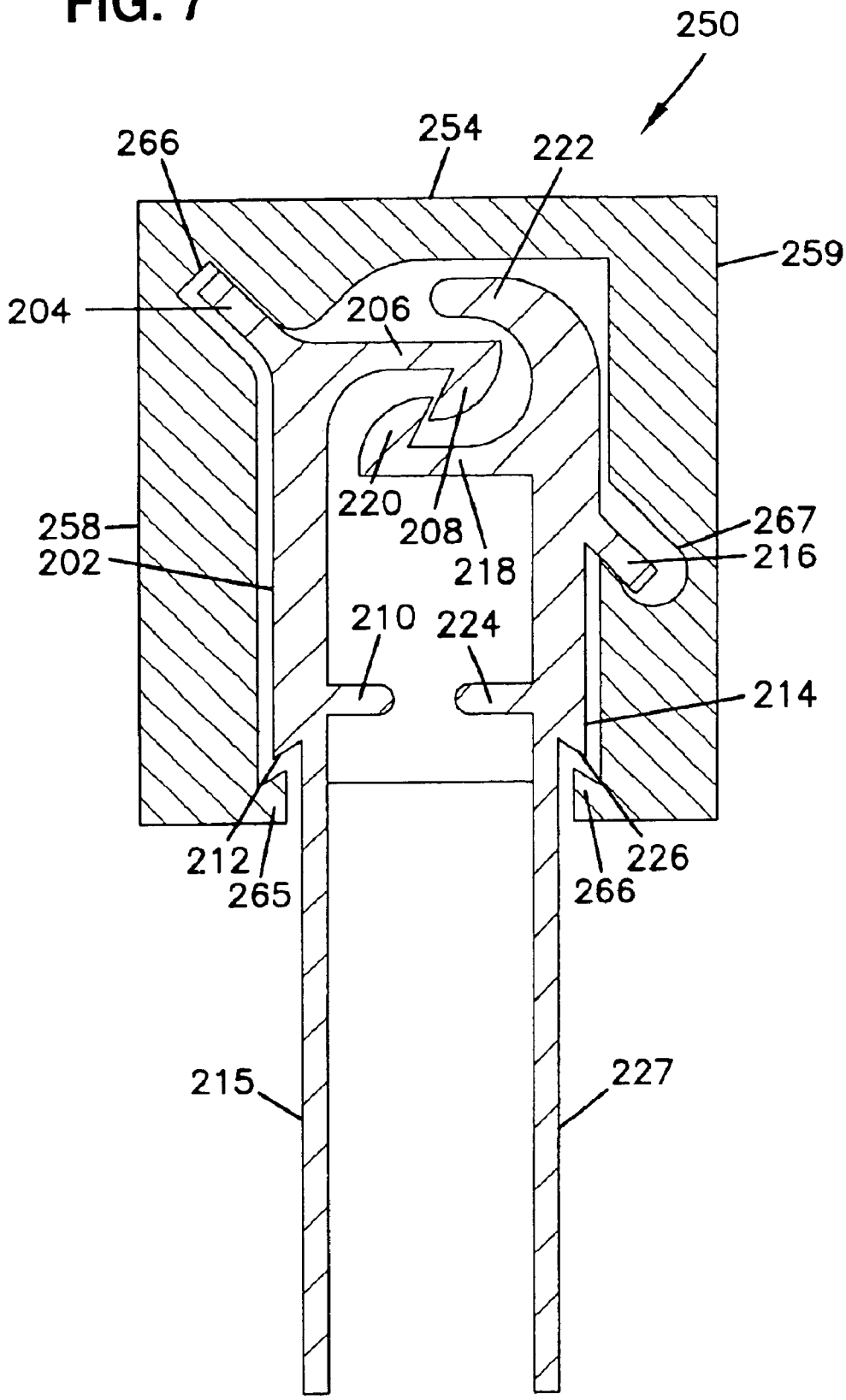
FIG. 7 is a cross-sectional view of the slider device of FIGS. 3 and 4 taken along the line A—A of FIG. 1 being operably mounted on the profiled elements depicted in FIG. 2.
Figure 8:
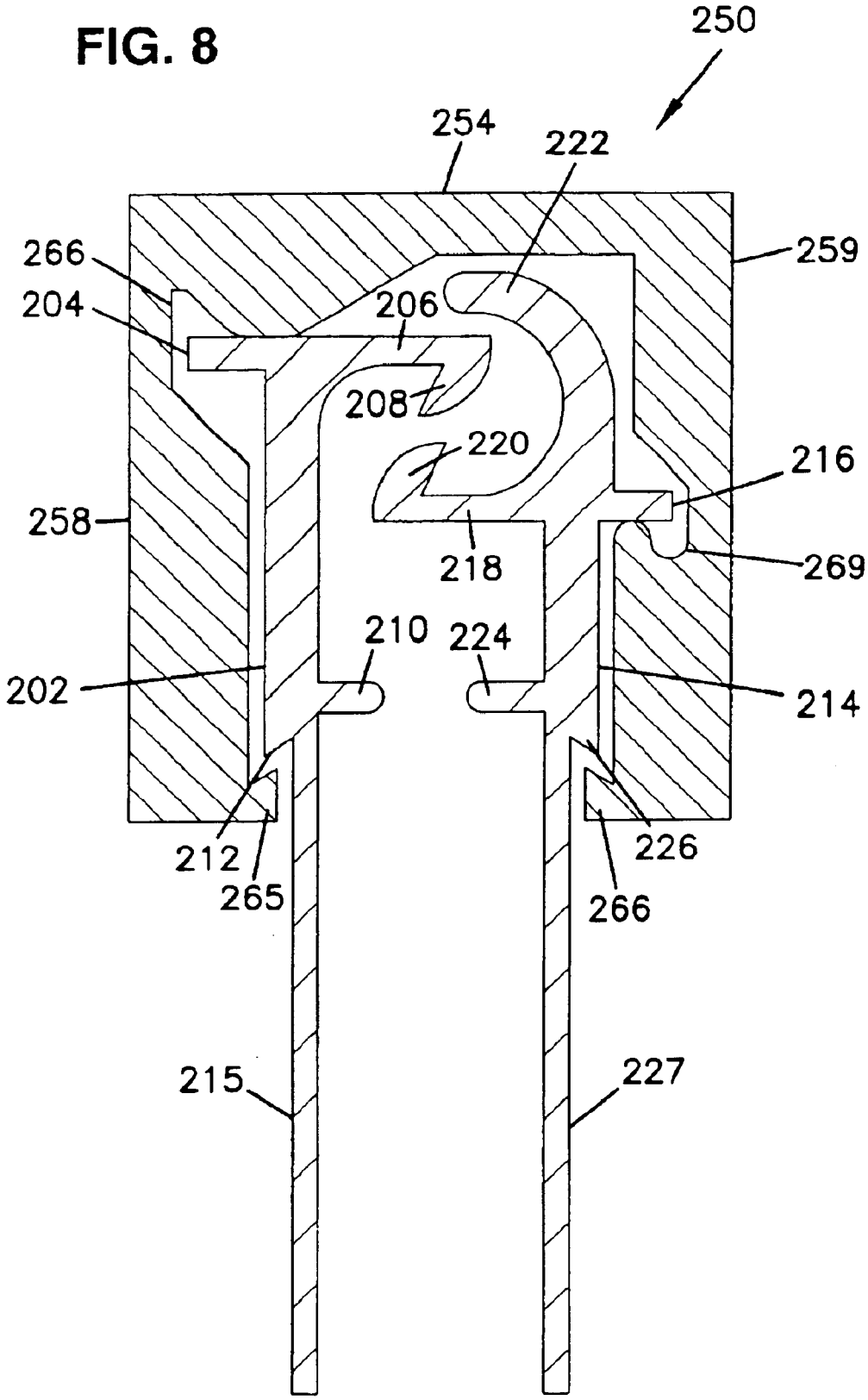
FIG. 8 is a cross-sectional view of the slider device of FIGS. 3 and 4 taken along the line B—B of FIG. 1 being operably mounted on the profiled elements depicted in FIG. 2.

Referring now to FIGS. 7 and 8, a cross-sectional view of the slider device 250 is shown at the first and second ends 255, 256 of the slider device 250, respectively, operably mounted on the resealable closure mechanism 200. FIG. 7 depicts a cross-section of the slider device 250 near the first end 255 of the slider device 250. The first slide channel 266 defined in the first sidewall 258 receives and engages the flange member 204 cantilevered from the first closure profile member 201. At the first end 255 of the slider device 250, the first slide channel 266 has a configuration that accommodates the flange member 204. By "accommodate," it is meant that the configuration of the first slide channel 266 does not engage, deflect, or exert any forces on the flange member 204 of the first closure profile 201. Similarly, at the first end 255 of the slider device 250, the second slide channel 267 has a configuration that accommodates the flange member 216. Thus, the first and second closure profiles 210, 213 are allowed to remain in a natural, unbiased configuration. Accordingly, when the first and second closure profiles 201, 213 are brought into engagement as shown in FIG. 7, the closure members 206, 218 are biased into an interlock position.

FIG. 8 depicts a cross-section of the slider device 250 near the second end 256 of the slider device 250. The configuration of the slide channel 266, 267 engages the flange members 204, 216 of the first and second closure profiles 210, 213. For example, as described above, the slide channels 266, 267 include contoured inner surfaces 266*a*, 267*a* that are sized and configured to engage the flange members 204, 216. By "engage," it is meant that the configuration of the slide channels 266, 269 deflect the flange members 204, 216 such that the closure members 206, 218 disengage. Specifically, the angling or jutting portion 266*b* pushes downwards on the flange member 204. In so doing, the first closure member 206 is correspondingly deflected upwards. Similarly, the angling or jutting portion 267*b* pushes upwards on the flange member 216. In so doing, the second closure member 218 is correspondingly deflected downwards. As a result, the first and second closure members 206, 218 disengage and may be pulled apart from one another to open the resealable package.

In one embodiment, the sidewalls 258, 259 are tapered. By "tapered," it is meant that the distance separating the slide channels 258, 259 decreases from the front end 255 of the slider device 250 to the second end 256 of the slider device 250. Accordingly, when the slider device 250 is moved along the resealable closure mechanism 200, the sidewalls at the second end 256 of the slider device 250 push the first and second closure profiles 201, 213 into engagement allowing the first and second closure members 206, 218 to interlock. Conversely, the sidewalls 258, 259 at the first end 255 of the slider device 250 tend to pull the first and second closure profiles 201, 213 apart.

Preferably, the housing 252 includes a system for permitting the housing 252 to slide along the resealable closure mechanism 200 without becoming disengaged from the resealable package. In the embodiment illustrated, the system of the slider housing 252 engages or interlocks with certain structure of the resealable closure mechanism 200. In particular, the housing 252 has a first and a second hook construction 265, 266. The first hook construction 265, preferably extends from the first sidewall 258 and the second hook construction 266 extends from the second sidewall 259. Accordingly, the first and second hook construction 265, 266 aid in separating the first and second closure profiles 201, 213 when the slider device 250 is moved along the resealable closure mechanism 200 in a second direction.

In operation, the slider device 250 is slid relative to the resealable closure mechanism 200 from the opened position adjacent to the side edge 122 to the closed position adjacent to the side edge 120. As the slider device 250 is moved from the opened position to the closed position, the slide channels 266, 267 slidably communicate with and receive the flange members 204, 216. For example, the slide channel 266 slidably communicates with and receives the flange member 204 allowing it remain in its natural, unbiased configuration as described above. Similarly, the slide channel 267 slidably communicates with and receives the flange member 216 allowing it to remain in its natural, unbiased configuration as described above. Furthermore, as discussed above, the sidewalls 258, 259 are tapered. Thus, as the slider device 250 is moved from the opened position to the closed position, the sidewalls 258, 259 at the first end 255 of the slider device 250 push or urge the first and second closure profiles 201, 213 into engagement. As a result, the first and second closure members 206, 218 are allowed to interlock.

Conversely, the slider device 250 may be slid relative to the resealable closure mechanism 200 from the closed position to the opened position. As the slider device 250 is moved from the closed position to the opened position, the slide channels 266, 267 slidably communicate with and engage the flange members 204, 216. For example, the slide channel 266 slidably communicates with and pushes downward on the first flange member 204, thereby causing the first closure member 206 to move upwards and away from the second closure member 218. Similarly, the slide channel 267 slidably communicates with and engages the second flange member 216, thereby causing the second closure member to move downwards and away from the first closure member 206. Accordingly, the first and second closure profiles 201, 213 disengage and allow access to the interior of the package. Furthermore, as discussed above, the sidewalls 258, 259 are tapered. Thus, as the slider device 250 is moved from the closed position to the opened position, the first and second hook construction 265, 266 of the slider device 250 engage the first and second shoulders 212, 226 of the first and second closure profiles 201, 213. In so doing, the first and second hook construction 265, 266 aid in separating the first and second closure profiles 201, 213 when the slider device 250 is moved along the resealable closure mechanism 200 from the closed position to the opened position.

The above specification and examples are believed to provide a complete description of the manufacture and use of particular embodiments of the invention. Many embodiments of the invention can be made without departing from the spirit and scope of the invention.

What is claimed is:

1. A flexible package comprising:

(a) a package surrounding wall having a mouth providing access to a package interior;

(b) a resealable closure mechanism along said mouth for selective closing and opening of said mouth; said resealable closure mechanism including first and second closure profiles;

(i) said first closure profile including: a first closure member; a first guidepost; a first sealing flange; a first catch integral with said first closure member; and a first shoulder; said first shoulder being between said first guidepost and said first sealing flange; said first closure profile also including a first flange member cantilevered from said first closure profile opposite said first closure member;

(ii) said second closure profile including: a second closure member; a second guidepost; a second sealing flange; a second catch integral with said second closure member; and a second shoulder; said second shoulder being between said second guidepost and said second sealing flange; said first and second catches being constructed and arranged for selective interlocking; said second closure profile also including a second flange member cantilevered from said second closure profile opposite said second closure member; and (c) a slider device operably mounted on said resealable closure mechanism for selectively closing and opening said resealable closure mechanism by moving said slider device relative to said resealable closure mechanism in opposite first and second directions; said slider device including:

(i) a top wall;

(ii) a first sidewall depending from said top wall; said first sidewall having first and second opposite ends; said first sidewall defining a first slide channel for receiving said first flange member cantilevered from said first closure profile; said first slide channel having a first guide construction for accommodating said first flange member; and said first sidewall is constructed and arranged to slidably engage said first shoulder when said slider device is moved along said resealable closure mechanism;

(iii) a second sidewall depending from said top wall; said second sidewall having first and second opposite ends; said second sidewall defining a second slide channel for receiving said second flange member cantilevered from said second closure profile; said second slide channel having a second guide construction for accommodating said second flange member; and said second sidewall is constructed and arranged to slidably engage said second shoulder when said slider device is moved along said resealable closure mechanism;

(iv) said first and second closure profiles being constructed and arranged to interlock when said slider device is moved in said first direction.

2. The flexible package of claim 1, wherein:

(a) said first slide channel is constructed and arranged to engage said first flange member when said slider device is moved in said second direction; and (b) said second slide channel is constructed and arranged to engage said second flange member when said slider device is moved in said second direction;

(i) said first and second closure profiles being constructed and arranged to disengage when said slider device is moved in said second direction.

3. The flexible package according to claim 2, wherein:

(a) said first slide channel has a first contoured inner surface; said first contoured inner surface being constructed and arranged to engage said first flange member when said slider device is moved in said second direction; and (b) said second slide channel has a second contoured inner surface; said second contoured inner surface being constructed and arranged to engage said second flange member when said slider device is moved in said second direction.

4. The flexible package according to claim 3, wherein:

(a) said first contoured inner surface includes a first protrusion located substantially near said first end of said first sidewall; said first protrusion being constructed and arranged to engage said first flange member when said slider device is moved in said second direction; and (b) said second contoured inner surface includes a second protrusion located substantially near said first end of said second sidewall; said second protrusion being constructed and arranged to engage said second flange member when said slider device is moved in a second direction.

5. The flexible package according to claim 1, wherein:

(a) said first and second sidewalls are tapered such that said first and second closure profiles are biased into engagement when said slider device is moved in said first direction.

6. The flexible package according to claim 1, wherein:

(a) said first and second sidewalls are tapered such that said first and second closure profiles are separated when said slider device is moved in said second direction.

7. The flexible package according to claim 1, wherein:

(a) said first sidewall has a hook construction to slidably cover and engage said first shoulder when said slider device is moved in a second direction; and (b) said second sidewall has a second hook construction to slidably cover and engage said second shoulder when said slider device is moved in a second direction.

8. A reclosable closure mechanism comprising:

(a) a first closure profile having: a first closure member; a first guidepost; a first sealing flange; a first catch integral with said first closure member; and a first shoulder; said first shoulder being between said first guidepost and said first sealing flange; said first closure profile also including a first flange member cantilevered from said first closure profile opposite said first closure member;

(b) a second closure profile having: a second closure member; a second guidepost; a second sealing flange; a second catch integral with said second closure member; and a second shoulder; said second shoulder being between said second guidepost and said second sealing flange; said first and second catches being constructed and arranged for selective interlocking; said second closure profile also including a second flange member cantilevered from said second closure profile opposite said second closure member; and (c) a slider device operably mounted on said first and second closure profiles for selectively closing and opening said reclosable closure mechanism by moving said slider device relative to said reclosable closure mechanism in opposite first and second directions; said slider device including:

(i) a top wall;

(ii) a first sidewall depending from said top wall; said first sidewall having first and second opposite ends; said first sidewall defining a first slide channel for receiving said first flange member cantilevered from said first closure profile; said first slide channel having a first guide construction for accommodating said first flange member and said first sidewall is constructed and arranged to slidably engage said first shoulder when said slider device is moved along said resealable closure mechanism;

(iii) a second sidewall depending from said top wall; said second sidewall having first and second opposite ends; said second sidewall defining a second slide channel for receiving said second flange member cantilevered from said second closure profile; said second slide channel having a second guide construction for accommodating said second flange member; and said second sidewall is constructed and arranged to slidably engage said second shoulder when said slider device is moved alone said resealable closure mechanism; and (iv) said first and second closure profiles being constructed and arranged to interlock when said slider device is moved in said first direction.

9. The reclosable closure mechanism of claim 8, wherein:

(a) said first slide channel is constructed and arranged to engage said first flange member when said slider device is moved in said second direction; and (b) said second slide channel further being constructed and arranged to engage said second flange member when said slider device is moved in said second direction;

(i) said first and second closure profiles being constructed and arranged to disengage when said slider device is moved in said second direction.

10. The reclosable closure mechanism of claim 9, wherein:

(a) said first slide channel has a first contoured inner surface; said first contoured inner surface being constructed and arranged to engage said first flange member when said slider device is moved in said second direction; and (b) said second slide channel has a second contoured inner surface; said second contoured inner surface being constructed and arranged to engage said second flange member when said slider device is moved in said second direction.

11. The reclosable closure mechanism according to claim 10, wherein:

(a) said first contoured inner surface includes a first protrusion located substantially near said first end of said first sidewall; said first protrusion being constructed and arranged to engage said first flange member when said slider device is moved in said second direction; and (b) said second contoured inner surface includes a second protrusion located substantially hear said first end of said second sidewall; said second protrusion being constructed and arranged to engage said second flange member when said slider device is moved in a second direction.

* * * * *